US008266858B2

(12) United States Patent
Teng

(10) Patent No.: US 8,266,858 B2
(45) Date of Patent: Sep. 18, 2012

(54) WATERPROOF HEAT-INSULATION CONSTRUCTION METHOD AND MODULE

(75) Inventor: Chung-Hsien Teng, Hsinchu County (TW)

(73) Assignee: Unisaf Enterprise Company Limited, Hukou Township, Hsinchu County (TW)

( * ) Notice: Subject to any disclaimer, the term of this patent is extended or adjusted under 35 U.S.C. 154(b) by 346 days.

(21) Appl. No.: 12/707,452

(22) Filed: Feb. 17, 2010

(65) Prior Publication Data

US 2011/0197532 A1 Aug. 18, 2011

(51) Int. Cl.
*E04B 1/78* (2006.01)
*E04B 1/80* (2006.01)

(52) U.S. Cl. ..... 52/407.3; 52/741.4; 52/793.1; 52/404.1; 52/404.4; 52/742.13; 52/745.06; 29/527.1; 29/527.2; 264/35; 264/259; 264/261; 264/265; 264/271.1; 428/72; 428/73

(58) Field of Classification Search ..... 52/404.1, 52/404.4, 407.3, 793.1, 741.4, 742.1, 742.13, 52/745.06, 745.08; 29/527.1, 527.2; 428/72, 428/73

See application file for complete search history.

(56) References Cited

U.S. PATENT DOCUMENTS

| | | | | | |
|---|---|---|---|---|---|
| 2,061,569 | A * | 11/1936 | Fischer | 428/73 |
| 2,470,501 | A * | 5/1949 | Leaman | 131/235.1 |
| 2,744,042 | A * | 5/1956 | Pace | 264/46.5 |
| 3,630,813 | A * | 12/1971 | Allen | 428/117 |
| 3,641,724 | A * | 2/1972 | Palmer | 52/793.11 |
| 3,895,152 | A * | 7/1975 | Carlson et al. | 428/116 |
| 4,299,872 | A * | 11/1981 | Miguel et al. | 428/117 |
| 4,360,021 | A * | 11/1982 | Stima | 604/365 |
| 4,548,007 | A * | 10/1985 | Newman | 52/309.11 |
| 4,934,018 | A * | 6/1990 | Fortier et al. | 15/312.1 |
| 5,309,690 | A * | 5/1994 | Symons | 52/309.9 |
| 6,061,993 | A * | 5/2000 | Bendixen et al. | 52/783.19 |
| 6,085,462 | A * | 7/2000 | Thomas | 47/87 |
| 6,753,067 | B2 * | 6/2004 | Chen et al. | 428/166 |
| 7,641,954 | B2 * | 1/2010 | Rouanet et al. | 428/76 |
| 7,707,799 | B2 * | 5/2010 | Wrass et al. | 52/784.14 |
| 2001/0002627 | A1 * | 6/2001 | Mattson et al. | 180/19.2 |
| 2011/0227298 | A1 * | 9/2011 | Teng | 277/645 |

FOREIGN PATENT DOCUMENTS

| | | |
|---|---|---|
| TW | 305906 | 5/1997 |

* cited by examiner

*Primary Examiner* — Robert Canfield
(74) *Attorney, Agent, or Firm* — Muncy, Geissler, Olds & Lowe, PLLC

(57) ABSTRACT

A waterproof heat-insulation construction method aims to spread a layer of waterproof heat-insulation powder through a waterproof heat-insulation module on a work surface to form waterproof and heat insulation effect thereof. The method comprises the steps of: first, anchoring at least one waterproof heat-insulation module which can be arranged on the work surface; then holding the waterproof heat-insulation powder in the waterproof heat-insulation module in contact with the work surface to form a waterproof heat-insulation layer. The invention also provides a corresponding waterproof heat-insulation module which can be constructed in a modular fashion to achieve waterproof and heat insulation effect for buildings.

19 Claims, 11 Drawing Sheets

WATERPROOF HEAT-INSULATION CONSTRUCTION METHOD AND MODULE

FIELD OF THE INVENTION

The present invention relates to a waterproof heat-insulation construction method and module and particularly to a waterproof heat-insulation construction method and module that use waterproof heat-insulation powder as a material.

BACKGROUND OF THE INVENTION

To meet the requirements of waterproof and heat insulation for buildings is a constant challenge in the industry. Water leakage on roofs and water permeation indoors to form efflorescence are always annoying problems to people living inside. They are mainly caused by water seeping from chinks and crannies that are reserved for shrink and expansion on the roofs or walls. When cement concrete is grouted for construction, the joints tend to form chinks and crannies. Moreover, the buildings often bear external forces such as earthquake and strong wind, or weathering of expanding when hot and shrinking when cold, or being exposed to the sun and rain. All these contribute formation of the chinks and crannies on the buildings. As a result, most buildings suffer from the problem of water leakage.

In the past, construction methods of waterproof and anti-leakage for roofs employ hard or soft material. The method with hard material is done by plastering with cement or mortar with stones in seven millimeters on the surface of water leakage boards. The method with soft material is done by spraying or plastering polymer waterproof materials such as asphalt, epoxy resin, polyurethane (PU) or the like on water leakage walls to block moisture. However, the coated hard material easily chaps due to poor construction, shoddy work and inferior material or weathering. The soft material tends to form air bubbles, deterioration, or poor extensibility, and defective bonding to the underneath concrete layer. Under the double impact of heat expansion and cold shrink or weathering, chaps or chinks are easily formed in a short period and result in water leakage again. Hence a periodical repair and maintenance are needed, and to perform a radical cure is difficult.

Moreover, with green building and energy saving becoming the mainstream concept in recent years, there is a growing eco-friendly and energy-saving appeal for maintaining constant indoor temperature and avoiding fluctuation of indoor temperature affected by outdoor extreme temperature. The conventional heat insulation methods on the buildings mostly use heat insulation materials such as heat insulation tiles, foamed cement, or Styrofoam or the like to fill in the building. The methods mentioned above not only provide limited heat insulation effect, also produce discarded Styrofoam that is difficult to be recycled and becomes a big environmental problem. They also do not fully conform to the modern concept of energy-saving, carbon reduction and full-utilization of resources. In addition, the conventional waterproof and heat-insulation construction has to be carried out separately, interference occurs without complementary or mutual enhancement effect.

R.O.C. patent No. 305906 entitled "Roof weather resistance construction method" discloses a method that combines waterproof and heat-insulation construction methods for roofs. It spreads waterproof heat-insulation powder which is hydrophobic and has a lower heat conductivity to achieve waterproof and heat insulation effect. The method of the construction is to spread waterproof heat-insulation powder at a thickness about 1 cm on the roof first; next, lay a loading board on the powder layer; then grout concrete or cement to form a cured layer. The method spreads the waterproof heat-insulation powder on the rooftop in a great area. It is difficult to maintain a constant thickness and amount on the uneven floor. Waterproof and heat insulation effect suffers. The powder on a great area is easily carried away by wind and scatters around when the construction is carried out and results in work difficulty, and also harms people's health and environment. Moreover, using the cured concrete layer as the weighting layer of the waterproof heat-insulation powder layer, support characteristic is inferior and degree of difficulty to construct tall buildings in urban area is higher. Shattering and cracking of the cured layer also is prone to happen due to uneven thickness of the powder. All these affect waterproof and heat—is prone to happen result. Furthermore, the aforesaid method merely is applicable to construction on the horizontal floor. For inclined walls or upright walls, chinks and crannies are easily formed and water leakage problem is difficult to overcome.

In short, the conventional waterproof and heat-insulation material and construction methods have difficulty to meet the accelerating weather change and cannot fully resolve problems of water leakage in building and swift temperature fluctuations. There is still a need to develop an improved waterproof heat-insulation construction method that is fast, convenient, eco-friendly and effective to thoroughly resolve the aforesaid problems.

SUMMARY OF THE INVENTION

Therefore, the primary object of the present invention is to provide a waterproof heat-insulation construction method and module that are adaptable to various types of walls such as horizontal, inclined, upright and the like, and also provide perfect waterproof and heat insulation effect for buildings.

To achieve the foregoing object, the waterproof heat-insulation construction method provided by the invention aims to spread a layer of waterproof heat-insulation powder on a work surface to achieve waterproof and heat insulation effect. The invention also provides a waterproof heat-insulation module including the waterproof heat-insulation powder. First, at least one waterproof heat-insulation module which can be arranged and composed is anchored on the work surface; then the waterproof heat-insulation powder held in the waterproof heat-insulation module is in contact with the work surface to form the waterproof heat-insulation layer.

In an embodiment of the invention, the waterproof heat-insulation module includes a frame which has one side containing a plurality of grating structures to form a plurality of penetrable housing compartments. The waterproof heat-insulation powder is held in the housing compartments in contact with the work surface to cover thereof. Then a cover layer is disposed on the housing compartments to confine the waterproof heat-insulation powder in the housing compartments without losing, thereby provides waterproof and heat insulation effect for the work surface.

In another embodiment, the waterproof heat-insulation module is used to position the waterproof heat-insulation powder on an upright surface or inclined wall surface. The module includes a frame with a free end at one side sealed by a drawing board. The frame has a plurality of inclined housing compartments at inner side, and each housing compartment has an open end blocked by the drawing board and holds the waterproof heat-insulation powder at a selected amount. The free end leans on the upright surface. The drawing board can be removed to make the waterproof heat-insulation powder positioned securely on the upright surface.

The present invention holds the waterproof heat-insulation powder through the waterproof heat-insulation module to prevent scattering of powder and dust. The waterproof heat-insulation module also provides support so that it can be adapted in diversified applications such as laying tiles, wooden boards, cement and the like indoors and outdoors. By holding the waterproof heat-insulation powder in the housing compartments, the problems incurred by relying on cement weighing in the conventional technique also can be resolved.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1A:
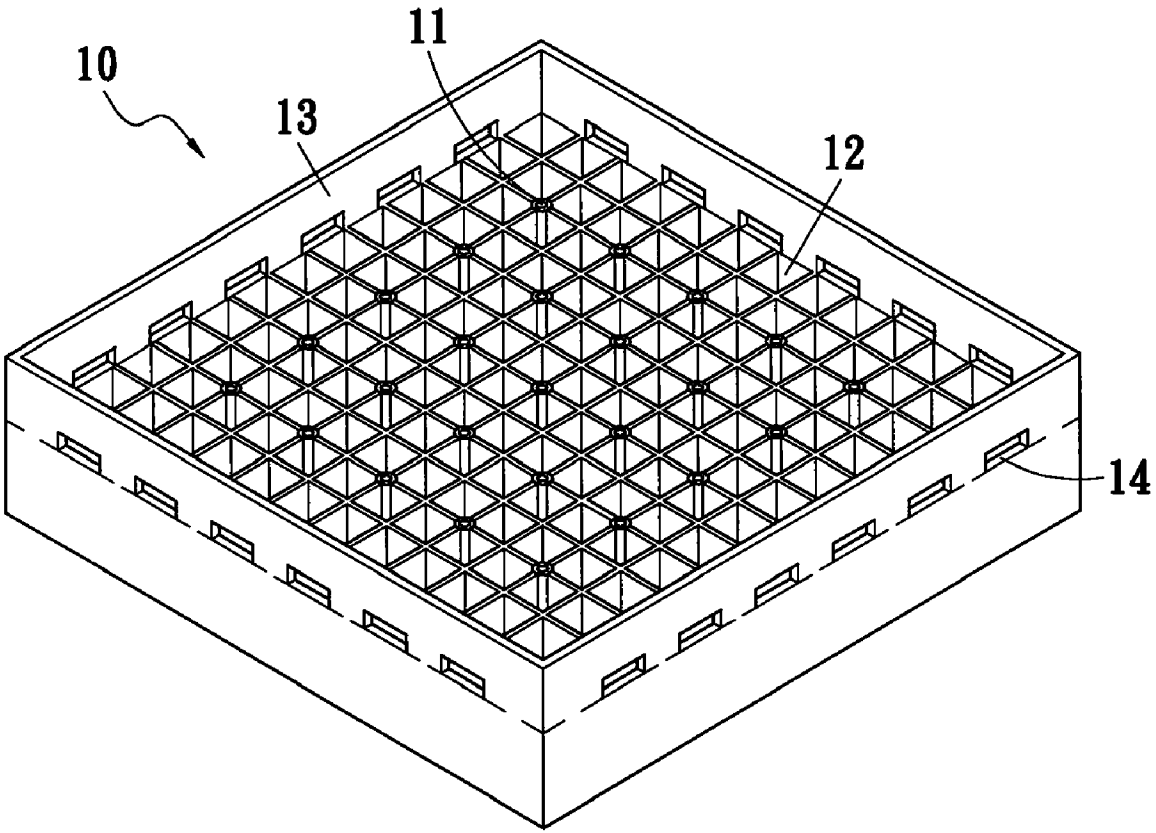
FIG. 1A is a perspective view of an embodiment of the waterproof heat-insulation module of the invention.

The present invention aims to provide waterproof and heat insulation function for a wall (or floor) through a waterproof heat-insulation modular construction approach by arranging, composing and assembling waterproof heat-insulation modules to form a waterproof heat-insulation layer on a work surface. Various embodiments of the method and module are depicted below according to waterproof heat-insulation powder characteristics, applicable planar floors and inclined or upright walls. Details are elaborated below.

Waterproof Heat-Insulation Powder:

The powder used in this invention is a waterproof heat-insulation powder that is hydrophobic and has a lower heat conductivity with a specific gravity (density) higher than pure water, and is not solvable in water, thus can prevent water from leaking from the upper side of a powder layer to the lower side. The powder is a natural powder or a powder that is ground, eco-friendly recycled and regenerated. It has eco-friendly characteristics such as incombustible, corrosion-resistant, non-toxic and odor-free, and also does not weathering, crack and deteriorate in a prolonged duration, thus can maintain stable quality to provide waterproof, humidity resistant, heat insulation and sound insulation effect for a long time period.

In one embodiment set forth above, the powder is a white powder consisting of calcium carbonate, Kaolin, quartz and the like that are obtained from natural ores and formed by grinding. It also is treated with a method such as modification of organic surfactant or surface treatment to make the powder surface contained hydrophobic ligands. Test results show that the waterproof heat-insulation powder has density between 2.6~2.73 ($g/cm^3$), heat conductivity coefficient is smaller than 0.07 (W/m·k), and does not contain heavy metal and other toxic materials such as silver, copper, asbestos, hexavalent chromium or the like. As the waterproof heat-insulation powder is obtained from nature, no environmental pollution occurs. Moreover, it is not chemical synthetic material, hence does not have aging, degradation or deterioration problem. It is to be noted that the waterproof heat-insulation powder made from different materials or production processes might have different characteristics in some degrees. The specifications of powder discussed in the embodiment merely serve for illustrative purpose and are not the limitations of the invention. The term of "waterproof heat-insulation powder" hereinafter is a general name for the powder that is hydrophobic and has lower heat conductivity.

Embodiment 1:

Embodiment 1 aims to discuss the waterproof heat-insulation construction method and module adopted on a flat floor and a slightly tilted plane. The waterproof heat-insulation construction method of the invention aims to position waterproof heat-insulation powder in contact with a wall (or floor) surface through a waterproof heat-insulation module in a modular fashion to fend off moisture and also avert heat alteration through the waterproof heat-insulation powder with a lower heat conductivity to protect indoor environments and maintain stable indoor temperature.

The Waterproof Heat-Insulation Construction Method Comprises the Steps as Follow:

1. Position and cover a plurality of waterproof heat-insulation modules on a work surface; each waterproof heat-insulation module contains a plurality of housing compartments;

2. Fill and confine waterproof heat-insulation powder in the housing compartments in contact with the work surface to provide protection thereof; and 3. Cover the waterproof heat-insulation modules with a cover layer.

Details of the steps are discussed as follow:

First, at step 1, the "work surface" is defined as a targeted area to be covered by the waterproof heat-insulation modules, but not limited to the entire floor (such as the entire rooftop area). Hence the "work surface" can cover a portion of space of the floor. The applicable scope of the invention also is not limited to outdoor rooftop space, but also is applicable to indoor environments. Before proceeding step 1, execute a sub-step 1-0: precondition a targeted work surface. The precondition broadly includes reinforcing the structure of the work surface, clearing dust and dirt, spraying a pliable waterproof film, trimming side edges and angles and/or flattening the floor and the like. This precondition aims to facilitate following processes and enhance overall waterproof and heat insulation effect. The precondition is not necessary, and the precondition content depends on the condition of the floor where the targeted work surface is located.

Step 1 aims to position a plurality of waterproof heat-insulation modules on the targeted work surface. Please refer to FIGS. 1A through 1C for an embodiment of a waterproof heat-insulation module 10 of the invention. In this embodiment, the waterproof heat-insulation module 10 is rectangular and includes a plurality of anchor holes 11 and a plurality of penetrable housing compartments 12 to hold waterproof heat-insulation powder 1. The waterproof heat-insulation module 10 can be anchored and mounted onto a work surface 2 by fastening nails or screws through the anchor holes 11 to prevent the waterproof heat-insulation module 10 from moving. In addition, a plurality of waterproof heat-insulation modules 10 can be arranged in an array manner or juxtaposed closely to extend flat surface to be anchored and covered on the work surface 2. Every two neighboring waterproof heat-insulation modules 10 are spaced with a desired gap to serve as an extensible crevice to accommodate heat expansion and cold shrink.

Figure 1B:
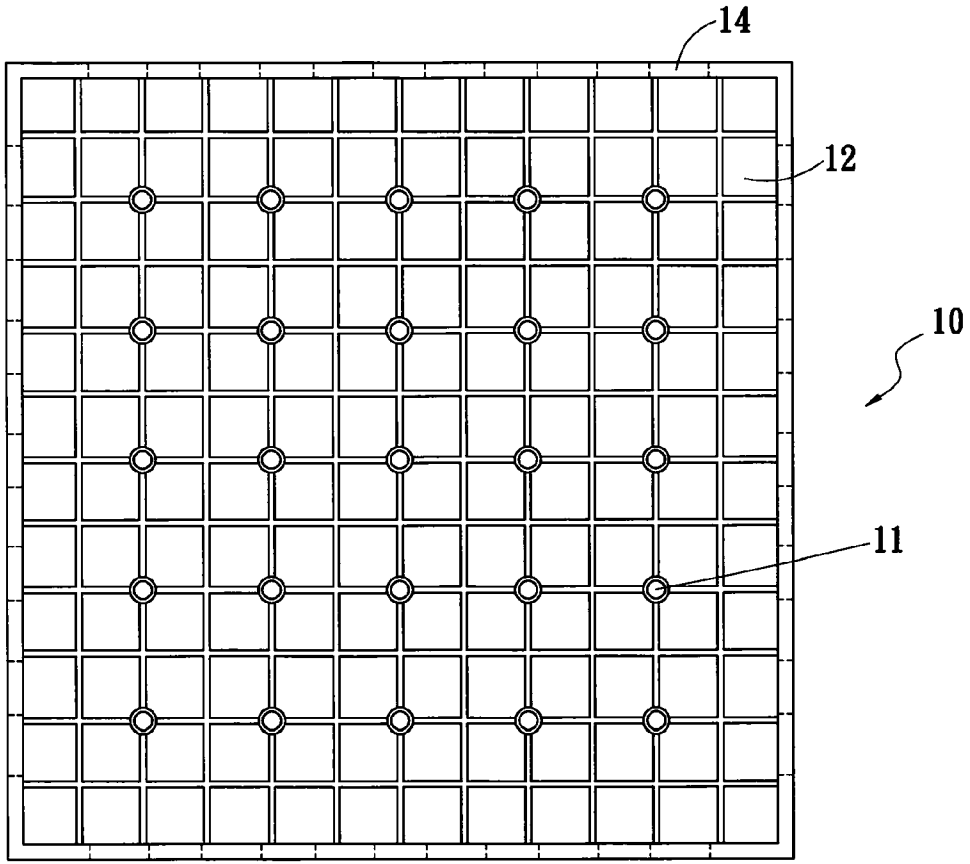
FIG. 1B is a top view of an embodiment of the waterproof heat-insulation module of the invention.
Figure 1C:
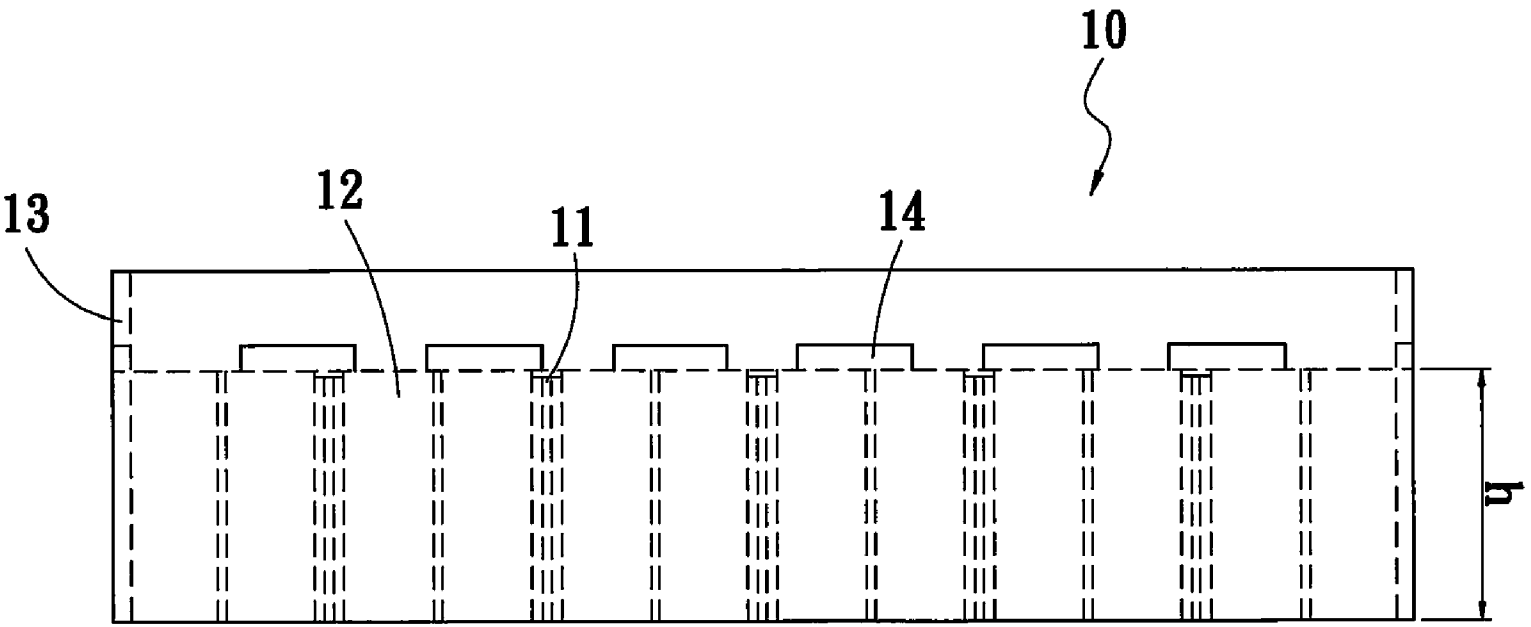
FIG. 1C is a side view of an embodiment of the waterproof heat-insulation module of the invention.
Figure 2:
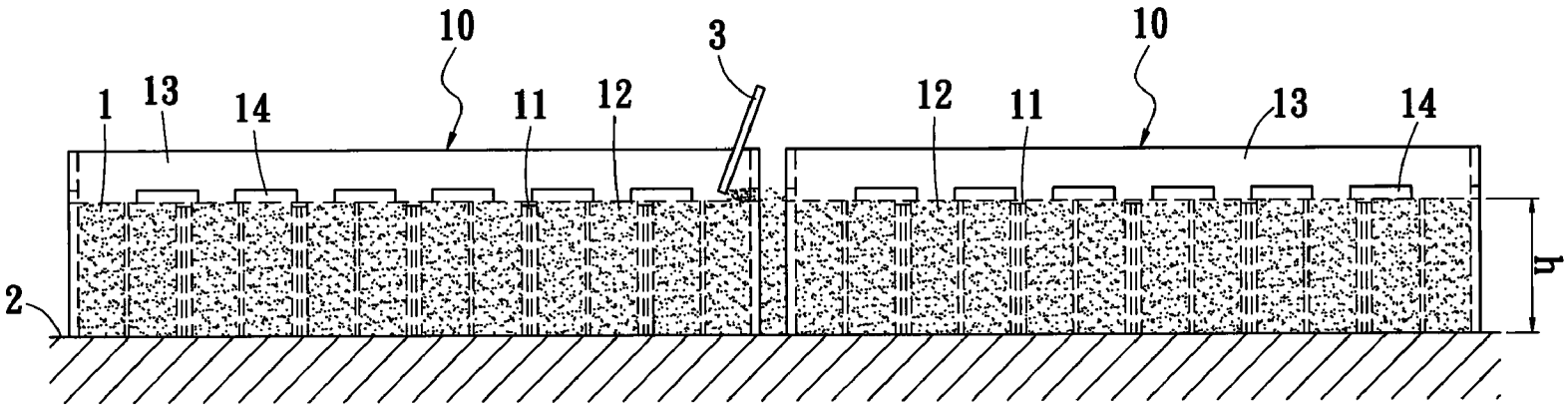
FIG. 2 is a side view of the invention with two neighboring waterproof heat-insulation modules.

Step 2, fill and confine the waterproof heat-insulation powder 1 in the housing compartments 12 in contact with the work surface 2 to form protection thereof. As the waterproof heat-insulation powder 1 has to be in contact with the work surface 2 to form a waterproof heat-insulation layer, the housing compartments 12 must contact with the work surface 2 without hindrance so that the waterproof heat-insulation powder 1 can be confined in the housing compartments 12 and also in contact with and cover the work surface 2. Referring to FIG. 2, after the waterproof heat-insulation modules 10 have been anchored on the work surface 2, spread a desired amount of the waterproof heat-insulation powder 1 thereon and flatten through a scraper so that the waterproof heat-insulation powder 1 is evenly filled and spread in each of the housing compartments 12 to cover the work surface 2 to form the waterproof heat-insulation layer. In this embodiment, the depths of housing compartments 12 (marked by h in FIG. 2) are equal and are as high as the actual thickness of the laid powder layer. Hence the waterproof heat-insulation powder 1 is prepared at an amount greater than the total holding volume of all housing compartments 12, and after filling all housing compartments 12, extra waterproof heat-insulation powder 1 can be scraped and flattened through a scraper 3 to form the waterproof heat-insulation layer. Referring to FIGS. 1A and 2, in this embodiment, the area that the perimeter height of the waterproof heat-insulation module 10 is greater than the depth h of the housing compartments 12 is defined as a holding frame 13. The circumference of the holding frame 13 has a plurality of apertures 14 formed thereon at an elevation higher than the depth h of the housing compartments 12. Hence the extra waterproof heat-insulation powder 1 can be expelled through the apertures 14 outside the waterproof heat-insulation module 10 and drops into the reserved gap between the two neighboring waterproof heat-insulation modules 10 as shown in FIG. 2. Thus the work surface 2 can be fully covered by the waterproof heat-insulation powder 1 to completely achieve waterproof and heat insulation effect.

It is to be noted that the aforesaid holding manner of the waterproof heat-insulation powder 1 is merely an embodiment example. In practice, every housing compartment 12 is not necessary to be filled with the waterproof heat-insulation powder 1, and the thickness of the layer of the waterproof heat-insulation powder 1 can be adjusted according to total requirement and heat conductivity thereof, preferably to achieve desired waterproof and heat insulation effect at a minimum thickness, such as 1 cm. To maintain overall waterproof and heat insulation effect, housing compartments 12 are filled with the waterproof heat-insulation powder 1 at the same thickness. The shape or forming method of the housing compartments 12 is not restricted. For instance, they may be formed in an interlaced grating structure with partitions crossing each other perpendicularly, or directly formed by injection forming or stamping. Each housing compartment 12 may be formed in a polygonal shape such as rectangular, then the housing compartments 12 can be arranged in a matrix array or beehive array, or the like without restriction.

Figure 3A:
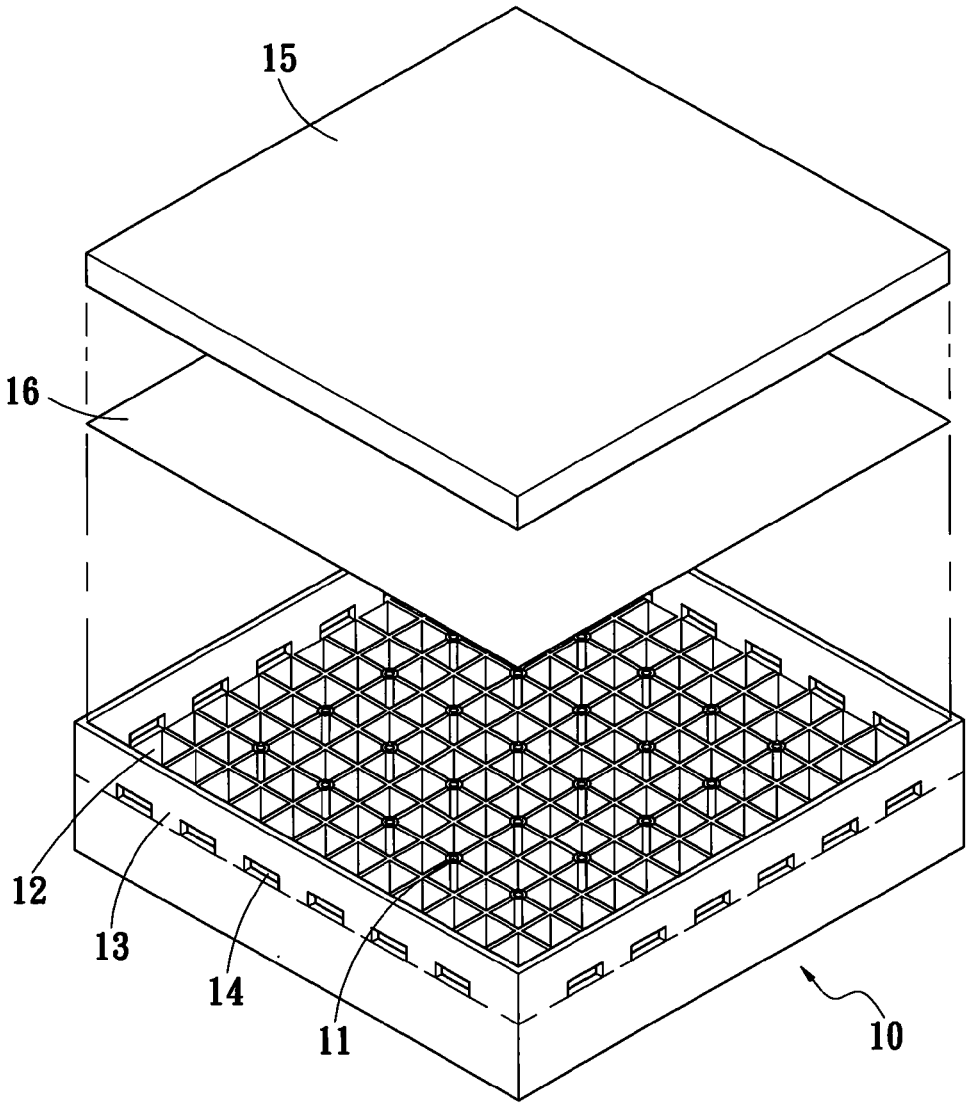
FIG. 3A is a schematic view of an application embodiment of the invention including a cover layer.
Figure 3B:
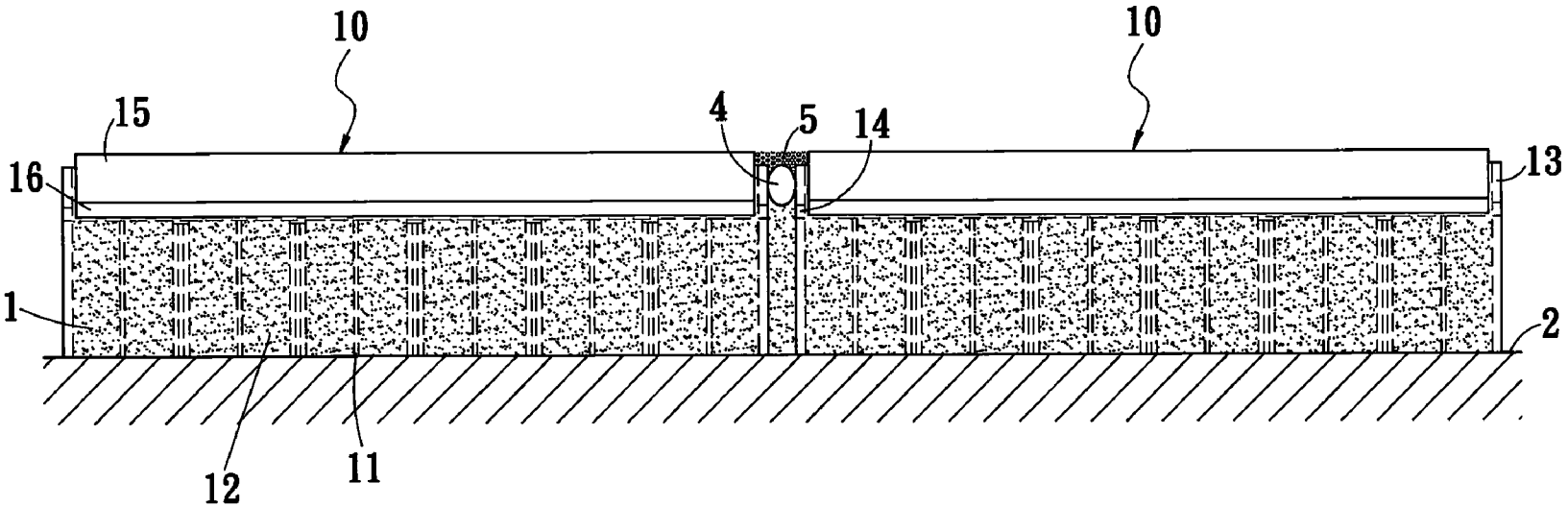
FIG. 3B is a schematic view according to FIG. 3A with two neighboring waterproof heat-insulation modules covered by a cover layer.

In addition, in order to prevent the waterproof heat-insulation powder 1 from spilling or scattering around, step 3 is adopted to cover the waterproof heat-insulation module 10 with a cover layer 15 for protection. The cover layer 15 may be made from ceramic tiles, floor tiles, wooden floor, concrete or the like. Refer to FIG. 3A for an example with the cover layer 15 made from ceramic tiles. After the layer of the waterproof heat-insulation powder 1 has been spread, the waterproof heat-insulation module 10 is covered with an isolation sheet 16 formed at a size mating the holding frame 13; then the isolation sheet 16 and the circumference of the inner edge of the holding frame 13 are sealed with a sealant; finally the ceramic tiles mating the size of the holding frame 13 are laid thereon. After each waterproof heat-insulation module 10 has been laid with the ceramic tiles, the gap between two neighboring waterproof heat-insulation modules 10 is filled with a filler strip 4 and/or a sealant 5 to ensure the waterproof heat-insulation powder 1 held inside does not scatter around as shown in FIG. 3B. The filler strip 4 may be made from polyethylene (PE), polyethylene glycols (PEG), polyethylene oxide (PEO) or the like.

Figure 4:
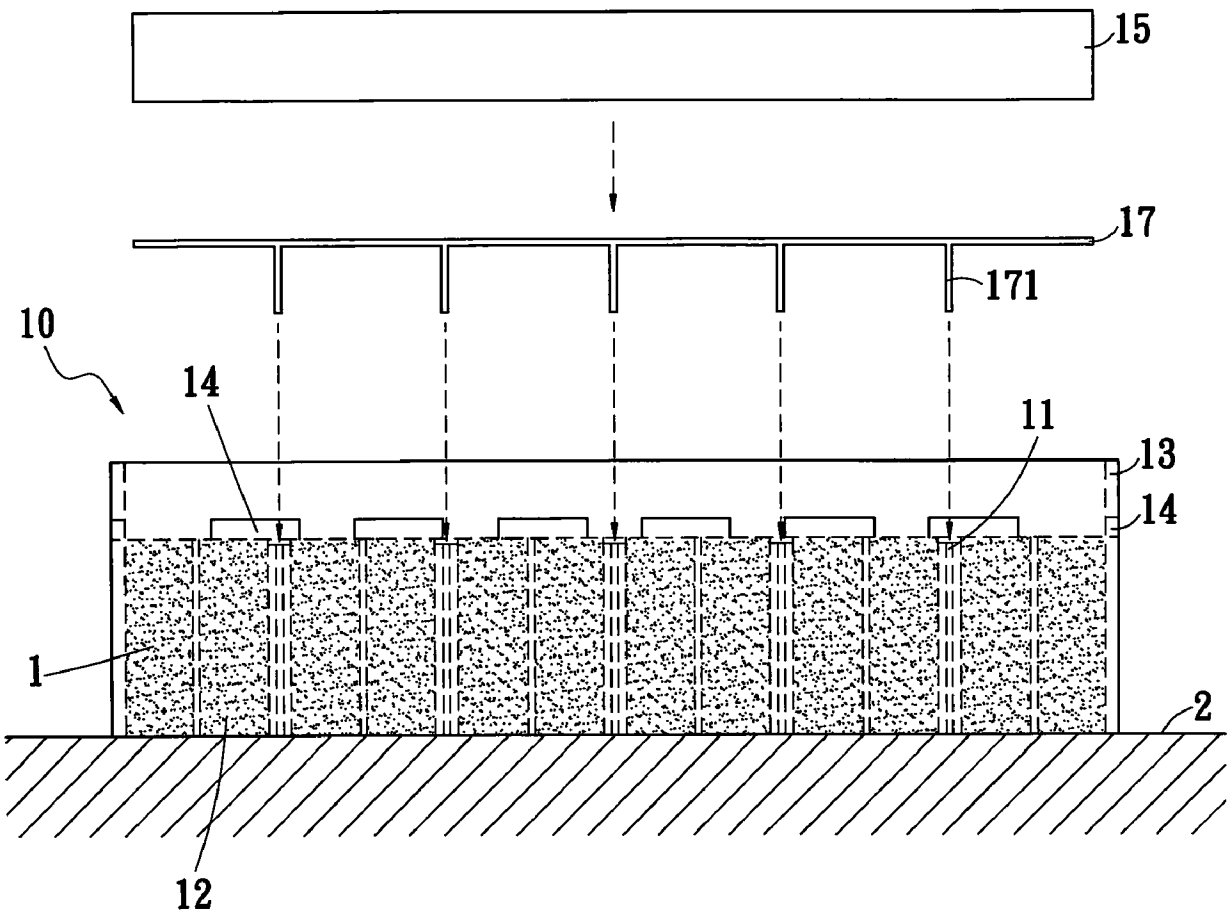
FIG. 4 is a schematic view of another application embodiment of the invention including the cover layer.

Another example is using concrete for the cover later 15. To enhance the structural strength of the concrete after grouting, and before grouting the concrete to the waterproof heat-insulation module 10 to form the cover layer 15, a structure reinforced member 17 is provided to reinforce the structure and support of the concrete to prevent it from chapping. Referring to FIG. 4, the structure reinforced member 17 is a metal mesh, as an example. The metal mesh is formed at a size mating the holding frame 13, and includes a plurality of upright anchor portions 171 to be inserted into the anchor holes 11 of the waterproof heat-insulation module 10 for anchoring, then the concrete is grouted to form the cover layer 15.

As the invention uses the waterproof heat-insulation powder 1 to be the waterproof heat-insulation layer, there is no need to remove the existing work surface 2 that is no longer functioning or has cracks formed thereon. By covering the waterproof heat-insulation powder 1 can achieve desired waterproof and heat insulation effect. Moreover, due to the waterproof heat-insulation powder 1 is fine articles and has desirable fluidity, it can automatically fill new cracks caused by earthquake or other factors to continuously maintain waterproof and heat insulation effect. Compared with the conventional techniques that directly spread the waterproof heat-insulation powder 1 in a large area and tend to cause scattering of the powder and dust or uneven thickness, the invention lays the waterproof heat-insulation modules 10 in a modular approach, thus can be assembled dynamically, flexibly and rapidly. As a result, the waterproof heat-insulation modules 10 not only can be made at varying sizes and thickness for customization according to different work surfaces 2, also can improve waterproof and heat insulation effect of part of the waterproof heat-insulation modules 10. In addition, the housing compartments 12 in the embodiment, aside from confining and holding the waterproof heat-insulation powder 1, also can provide support to bear the weight of the cover layer 15.

Figure 5:
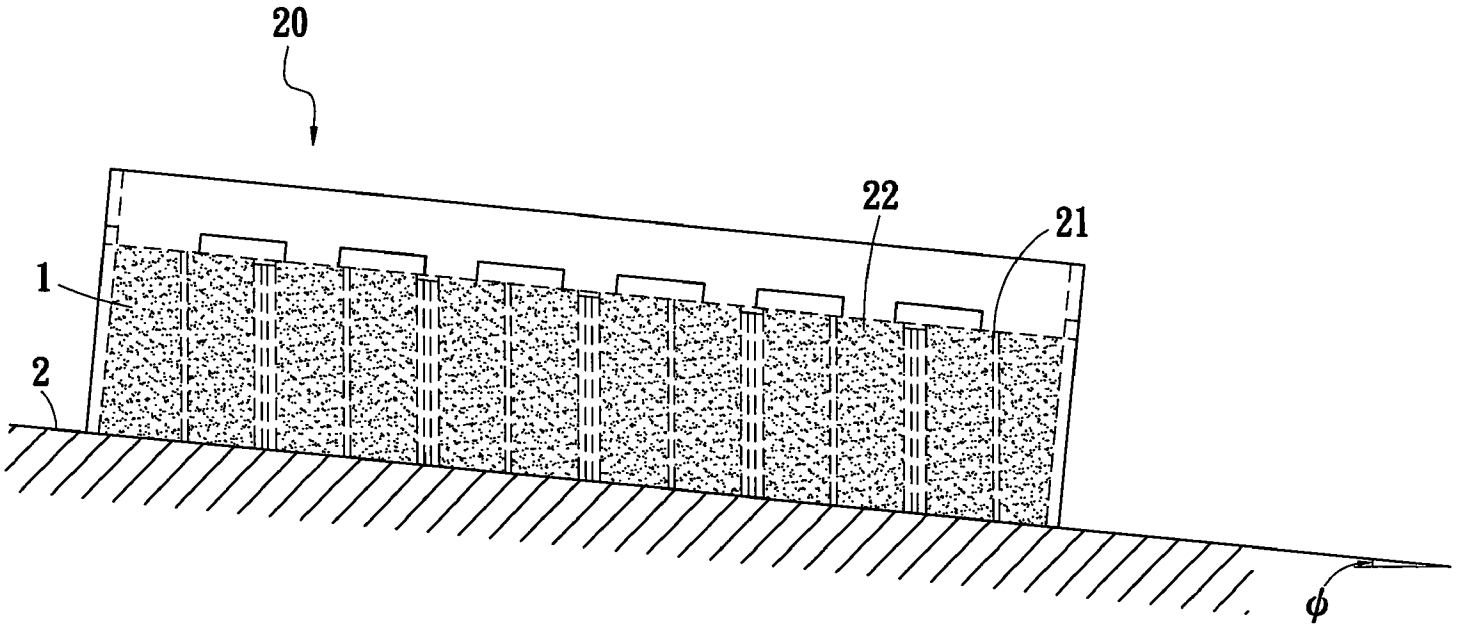
FIG. 5 is a side view of another embodiment of the waterproof heat-insulation module of the invention.

Embodiment 2:

For the wall or floor tilted at a smaller angle, the conventional techniques are difficult to achieve waterproof and heat insulation effect with the waterproof heat-insulation powder 1. The invention, by adopting the modular approach, can form a waterproof heat-insulation layer to achieve waterproof and heat insulation effect. For a situation with a smaller tilted angle, the method and module depicted in embodiment 1 is applicable. Embodiment 2 illustrates another waterproof heat-insulation module 20 adoptable for situation with a greater tilted angle. Referring to FIG. 5, compared with the grating structure depicted in embodiment 1 that is perpendicular to a horizontal plane, for a given floor or wall (work surface) at an inclined angle $\phi$, the waterproof heat-insulation module 20 contains a grating structure 21 formed in an inclined manner against the horizontal plane. Hence housing compartments 22 also are formed in a tilted manner corresponding to the inclined angle $\phi$. When the waterproof heat-insulation module 20 is located in the tilted manner, the grating structure 21 still remains perpendicular to the horizontal plane, hence the waterproof heat-insulation powder 1 can be directly covered on the work surface 2 towards the gravity force direction. Thus the waterproof heat-insulation construction method used in embodiment 1 can also be adopted on the work surface 2 with the inclined angle $\phi$.

Figure 6A:
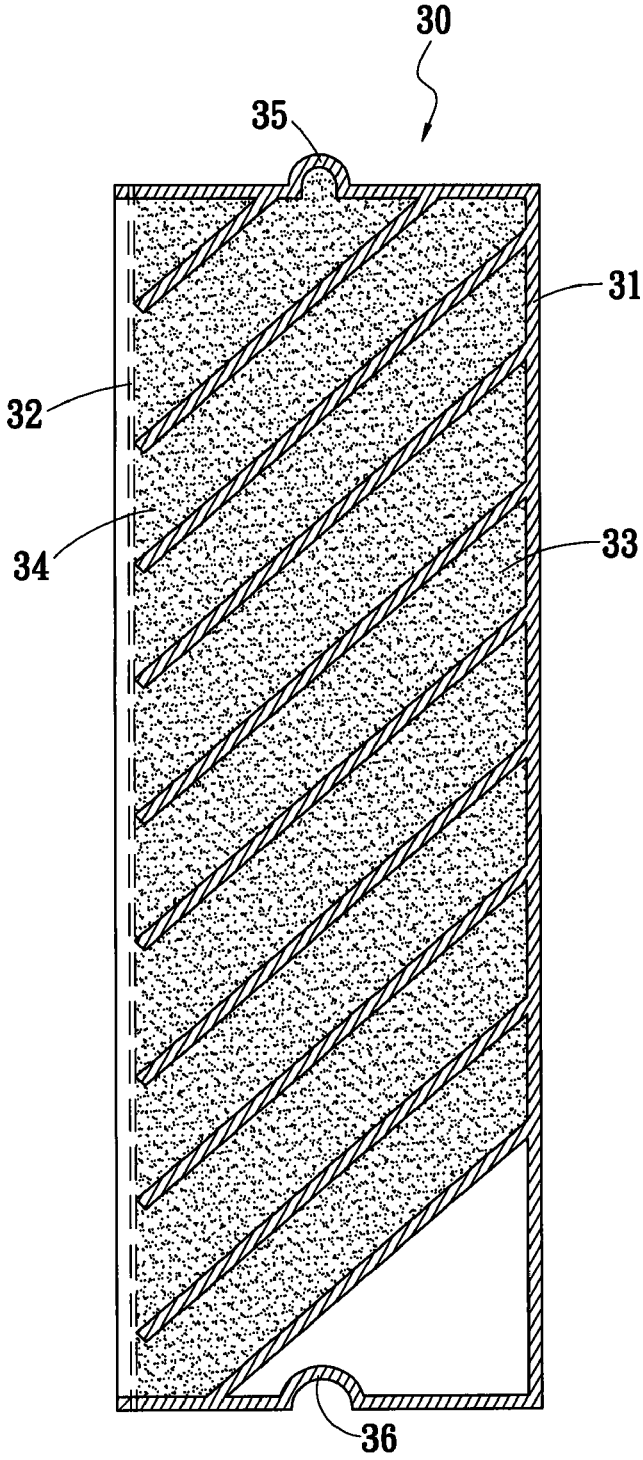
FIG. 6A is a side sectional view of another embodiment of the waterproof heat-insulation module of the invention.

Embodiment 3:

The waterproof heat-insulation powder 1 of the invention can be coupled with a waterproof heat-insulation module 30 to be used on an upright surface and an inclined surface. The following is an example with the waterproof heat-insulation module 30 adopted on an upright surface. Referring to FIG. 6A, the waterproof heat-insulation module 30 includes a rectangular cubical frame 31 which has one side formed a free end covered and sealed by a drawing board 32. The rectangular cubical frame 31 has an inner side including a plurality of inclined housing compartments 33 directing towards the gravity force (not being limited to parallel with the gravity force). Each housing compartment 33 has an open end 34 blocked by the drawing board 32. Each housing compartment 33 holds a selected amount of waterproof heat-insulation powder 1.

Figure 6B:
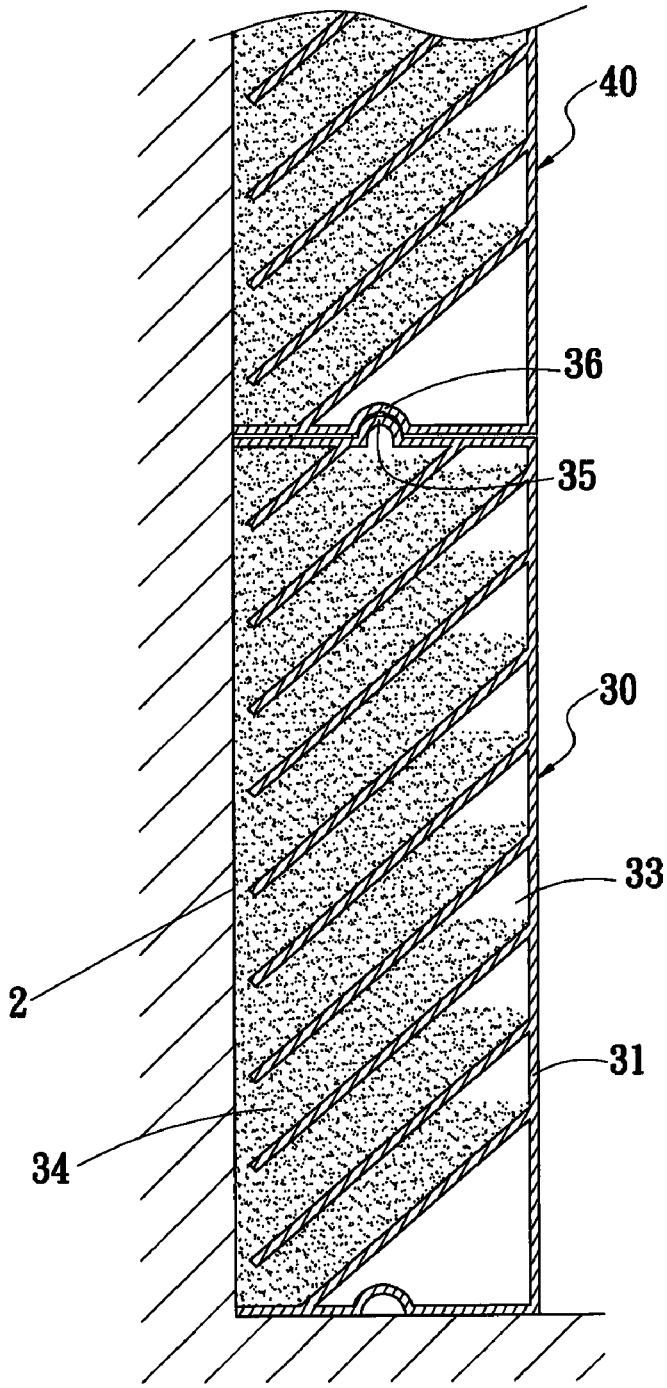
FIG. 6B is a sectional view of another embodiment of the waterproof heat-insulation module of the invention in a coupling condition.

Refer to FIGS. 6A and 6B for an embodiment with the waterproof heat-insulation module 30 adopted on an inclined wall or upright wall. In the event that the work surface 2 is an upright wall, the waterproof heat-insulation module 30 can be arranged and assembled to form a waterproof heat-insulation surface. The procedures include:

1. Position the waterproof heat-insulation module 30 on the work surface 2; the drawing board 32 of the waterproof heat-insulation module 30 faces the work surface 2 so that the housing compartments 33 face the work surface 2 and incline towards the gravity force direction;

2. Remove the drawing board 32 so that the waterproof heat-insulation powder 1 covers the work surface 2 along the tilted housing compartments 33;

3. Take another waterproof heat-insulation module 40 and assemble it on the waterproof heat-insulation module 30 of step 1, repeat the procedures of step 1 and step 2.

Details of the steps are elaborated as follow:

First, at step 1, face the free end of the waterproof heat-insulation module 30 equipped with the drawing board 32 towards the work surface 2 and anchor thereon. The work surface 2, as previously discussed, is defined as a targeted area to be covered by the waterproof heat-insulation module 30, but not limited to the entire upright surface or part of the area. Due to the housing compartments 33 of the waterproof heat-insulation module 30 face the work surface 2 and inclines towards the gravity force direction, the waterproof heat-insulation powder 1 in each housing compartment 33 slides towards the open end 34 of the housing compartment 33 along the gravity force direction, and leans on the drawing board 32 to be stopped thereon.

After the waterproof heat-insulation module 30 is held securely, the drawing board 32 is removed at step 2, and the waterproof heat-insulation powder 1 in the housing compartment 33 slides along the inclined surface to cover the work surface 2. It is to be noted that each housing compartment 33 including "a selected amount of waterproof heat-insulation powder 1" means that the amount of the waterproof heat-insulation powder 1 must cover the surface of the open end 34 of the housing compartment 33, but does not means that every housing compartment 33 contains an equal amount of waterproof heat-insulation powder 1.

Figure 6C:
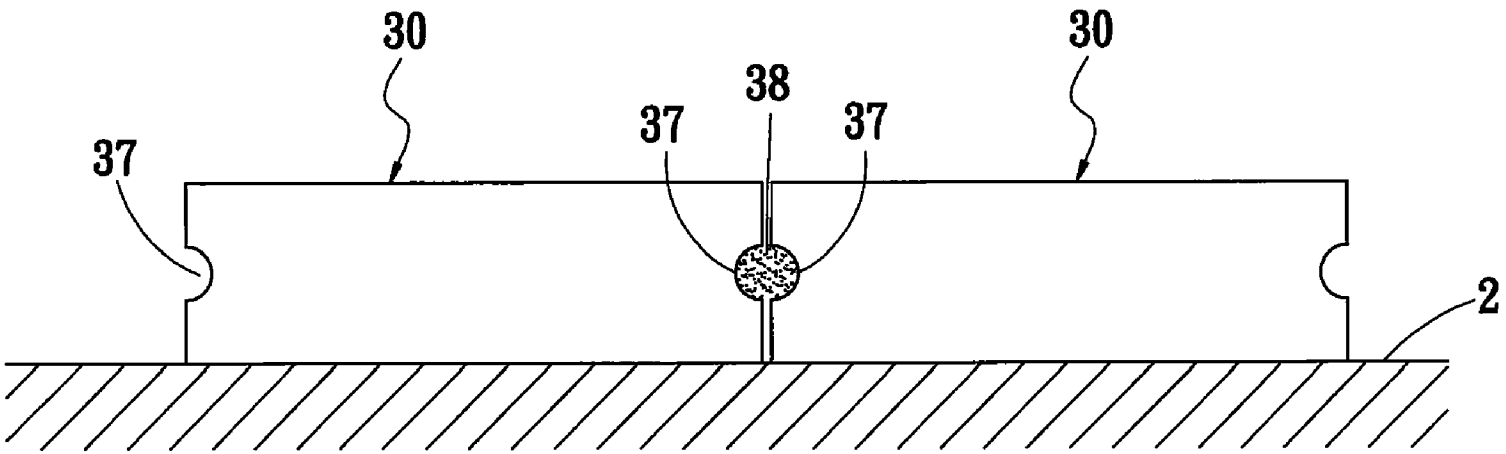
FIG. 6C is a top view of another embodiment of the waterproof heat-insulation module of the invention in a coupling condition.

In this embodiment, the waterproof heat-insulation module 30 is mounted and assembled on the upright surface from the lower side towards the upper side. Hence at step 3, the second waterproof heat-insulation module 40 has to be mounted on the waterproof heat-insulation module 30 of step 1. Refer to FIG. 6B for an embodiment which has two waterproof heat-insulation modules 30 and 40 coupled in an up and down manner. The waterproof heat-insulation modules 30 and 40 have respectively a first latch portion 35 and a second latch portion 36 that are formed at a size mating each other for latching and anchoring. Hence the second latch portion 36 of the waterproof heat-insulation module 40 at the upper side can be latched and anchored on the first latch portion 35 of the waterproof heat-insulation module 30 at the lower side in a stacked and upright manner. On the other hand, the waterproof heat-insulation module 30 also can be assembled horizontally to provide extended protection for the work surface 2. In another embodiment, the waterproof heat-insulation module 30 has two vertical sides respectively formed a groove 37, such that two neighboring waterproof heat-insulation modules 30 have two abutting grooves 37 mating each other to form a holding trough 38 as shown in FIG. 6C. The holding trough 38 can be filled with the waterproof heat-insulation powder 1 or a filler strip or a sealant to ensure the gap formed between two neighboring waterproof heat-insulation modules 30 to prevent moisture from entering, thereby to provide desired protection effect.

As a conclusion, whether the work surface is horizontal, inclined or upright, the modular construction method can be applied to cover the waterproof heat-insulation module on the work surface and achieve the object of waterproof and heat insulation.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A waterproof heat-insulation construction method to spread a layer of waterproof heat-insulation powder on a work surface, the method comprising the steps of:

positioning and covering a plurality of waterproof heat-insulation modules on the work surface, each of the waterproof heat-insulation modules including a plurality of housing compartments;

filling the waterproof heat-insulation powder in the housing compartments in contact with the work surface; and disposing a cover layer on the housing compartments to confine the waterproof heat-insulation powder in the housing compartments.

2. The waterproof heat-insulation construction method of claim 1, wherein the step of positioning the waterproof heat-insulation modules on the work surface is preceded by a precondition on the work surface.

3. The waterproof heat-insulation construction method of claim 1, wherein each of the waterproof heat-insulation modules includes a plurality of anchor holes for anchoring on the work surface.

4. The waterproof heat-insulation construction method of claim 3, wherein the cover layer is formed by grouting concrete that is preceded by inserting a structure reinforced member into the anchor holes of the waterproof heat-insulation modules to prevent the cover layer from chapping.

5. The waterproof heat-insulation construction method of claim 1, wherein the cover layer is selected from the group consisting of ceramic tiles, floor tiles and wooden boards.

6. The waterproof heat-insulation construction method of claim 1, wherein the step of disposing the cover layer on the housing compartments is followed by filling a gap formed on the periphery of the waterproof heat-insulation module with a sealant or a filler strip.

7. The waterproof heat-insulation construction method of claim 1, wherein the work surface is substantially horizontal.

8. A waterproof heat-insulation module to position waterproof heat-insulation powder on a flat surface, comprising a frame which has one side including a plurality of grating structures to form a plurality of housing compartments, each of the housing compartments being filled with the waterproof heat-insulation powder to cover the flat surface.

9. The waterproof heat-insulation module of claim 8 further comprising a plurality of anchor holes for anchoring on the flat surface.

10. The waterproof heat-insulation module of claim 8, wherein the frame includes a holding frame on another side opposite to the grating structures, the holding frame including a plurality of apertures to expel extra waterproof heat-insulation powder.

11. The waterproof heat-insulation module of claim 8, wherein the waterproof heat-insulation module is rectangular.

12. The waterproof heat-insulation module of claim 8 further comprising a cover layer mating the size of the frame to confine the waterproof heat-insulation powder in the housing compartments.

13. The waterproof heat-insulation module of claim 8, wherein the grating structures are perpendicular to a horizontal surface.

14. The waterproof heat-insulation module of claim 8, wherein the grating structures are inclined against the horizontal surface.

15. A waterproof heat-insulation construction method to dispose a plurality of waterproof heat-insulation modules spread with a layer of waterproof heat-insulation powder on an upright or an inclined work surface, the waterproof heat-insulation modules including a plurality of inclined housing compartments each holding a selected amount of waterproof heat-insulation powder, each housing compartment being covered by a drawing board, the method comprising the steps of:

positioning the waterproof heat-insulation module on the work surface, the drawing board facing the work surface such that the housing compartments face the work surface and incline towards gravity force direction;

removing the drawing board to allow the waterproof heat-insulation powder to cover the work surface along the inclined housing compartments; and taking and assembling another waterproof heat-insulation module on the waterproof heat-insulation module, and repeating the previous steps.

16. A waterproof heat-insulation module to position waterproof heat-insulation powder on an upright or inclined surface, comprising a frame which includes one side formed a free end and closed by a drawing board, and a plurality of housing compartments located inside and inclined towards gravity force direction, each of the housing compartments including an open end blocked by the drawing board and holding a selected amount of waterproof heat-insulation powder, the free end leaning on the upright surface which is covered by and in contact with the waterproof heat-insulation powder by removing the drawing board.

17. The waterproof heat-insulation module of claim 16 further comprising a first latch portion and a second latch portion that are located at two different ends of the frame corresponding to each other, two waterproof heat-insulation modules being couplable with each other by latching the first latch portion on the second latch portion.

18. A waterproof heat-insulation module to position waterproof heat-insulation powder on a flat surface, comprising a plurality of housing compartments, each including an opening to hold the waterproof heat-insulation powder in the housing compartment, the opening being covered and the waterproof heat-insulation powder being in contact with the flat surface in a anchoring manner.

19. A waterproof heat-insulation construction method to spread a layer of waterproof heat-insulation powder on a work surface, comprising:

anchoring at least one waterproof heat-insulation module which can be arranged on the work surface; and holding the waterproof heat-insulation powder in the waterproof heat-insulation module in contact with the work surface to form waterproof and heat insulation effect on the work surface.

* * * * *